United States Patent [19]

Hood

[11] Patent Number: 4,569,558

[45] Date of Patent: Feb. 11, 1986

[54] DRAG BIT CONSTRUCTION

[75] Inventor: Michael Hood, Lafayette, Calif.

[73] Assignee: The Regents of the University of California, Berkeley, Calif.

[21] Appl. No.: 516,909

[22] Filed: Jul. 25, 1983

[51] Int. Cl.[4] ..... E21C 25/60; E21C 7/08; E21F 5/02

[52] U.S. Cl. ..... 299/81; 299/16; 299/17

[58] Field of Search ..... 299/86, 81, 12, 1, 16, 299/17

[56] References Cited

U.S. PATENT DOCUMENTS

| | | | |
|---|---|---|---|
| 1,388,490 | 8/1921 | Suman . | |
| 2,357,835 | 9/1944 | Leissler . | |
| 3,153,458 | 10/1964 | Short | 175/329 |
| 3,298,451 | 1/1967 | Eckel et al. | 175/393 |
| 3,544,166 | 12/1970 | Proctor | 299/81 |
| 3,865,202 | 2/1975 | Takahashi et al. | 175/393 |
| 4,251,109 | 2/1981 | Roepke | 299/12 |
| 4,280,735 | 7/1981 | Lobbe | 299/81 |
| 4,333,687 | 6/1982 | Barnstorf | 299/81 |
| 4,334,585 | 6/1982 | Upton | 175/329 |
| 4,405,178 | 9/1983 | Brandenburg | 299/81 |
| 4,443,038 | 4/1984 | Brown | 299/81 |
| 4,456,306 | 6/1984 | Wrulich et al. | 299/81 |
| 4,488,758 | 12/1984 | Clemmow et al. | 299/81 |

FOREIGN PATENT DOCUMENTS

| | | | |
|---|---|---|---|
| 1126766 | 6/1982 | Canada | 299/81 |
| 621873 | 8/1978 | U.S.S.R. | 299/81 |
| 717326 | 2/1980 | U.S.S.R. | 299/81 |

OTHER PUBLICATIONS

Journal of South African Institute of Mining & Metallurgy, vol. 77, No. 4, Nov. 1976, pp. 79-90.

Research Review 1975/76, Chamber of Mines South Africa pp. 66-74.

Hood, M., 1978, A Study of Methods to Improve the Performance of Drag Bits Used to cut Hard Rock", PhD. Thesis, University of Witwatersrand, R.S.A.

Ropchan et al., 4/1980, Application of Water Jet Assisted Drag Bit and Pick Cutters for the Cutting of Coal Measure Rocks" Final Technical Report Submitted to the U.S. DOE Contract No. ET-77G-01-9082.

Tomlin, M. 5/1982, "Field Trials with 10,000 psi Prototype System" Proc. Seminar on Water Jet Assisted Roadheaders for Rock Excavation, sponsored by DOE/NCB Pittsburgh, Pa. pp. C1-C11.

*Primary Examiner*—Stephen J. Novosad
*Assistant Examiner*—Michael Goodwin
*Attorney, Agent, or Firm*—Lothrop & West

[57] ABSTRACT

A mounting movable with respect to an adjacent hard face has a projecting drag bit adapted to engage the hard face. The drag bit is disposed for movement relative to the mounting by encounter of the drag bit with the hard face. That relative movement regulates a valve in a water passageway, preferably extending through the drag bit, to play a stream of water in the area of contact of the drag bit and the hard face and to prevent such water play when the drag bit is out of contact with the hard face.

1 Claim, 4 Drawing Figures

DRAG BIT CONSTRUCTION

The Government has rights in this invention pursuant to Contract No. DE-AC03-76SF00098 awarded by the U.S. Department of Energy.

CROSS-REFERENCE TO RELATED APPLICATIONS

None.

BRIEF SUMMARY OF THE INVENTION

A drag bit is mounted to move with and with respect to a mounting to control the flow of a water jet toward the drag bit cutting edge but only during contact of the drag bit and a rock or other hard face being worked on.

PRIOR ART OF INTEREST

Prior art presently known to the applicant is:

Journal of the South African Institute of Mining & Metallurgy, Vol. 77, Number 4, November 1976, pages 79–90

Research Review 1975/76—Chamber of Mines of South Africa

Hood, M. (1978) "A Study of Methods to Improve the Performance of Drag Bits Used to Cut Hard Rock," Ph.D. thesis, University of Witwatersrand, R.S.A.

Ropchan, et al. (April 1980) "Application of Water Jet Assisted Drag Bit and Pick Cutters for the Cutting of Coal Measure Rocks," Final Technical Report submitted to U.S. DoE, Contract No. ET-77G-01-9082

Tomlin, M. (May 1982) "Field Trials with 10,000 psi Prototype System," Proc. Seminar on Water Jet Assisted Roadheaders for Rock Excavation, sponsored by DoE/NCB, Pittsburgh, PA, pp. C1–C11

U.S. Pat. Nos.: 1,388,490, Suman, Aug. 23, 1921; 2,357,835, Leissler, Sept. 12, 1944; 3,153,458, Short, Oct. 20, 1964; 3,298,451, Eckel et al., Jan. 17, 1967; 3,865,202, Takahashi et al., Feb. 11, 1975; 4,251,109, Roepke, Feb. 17, 1981; 4,334,585, Upton, June 15, 1982.

DETAILED DESCRIPTION

Figure 1:
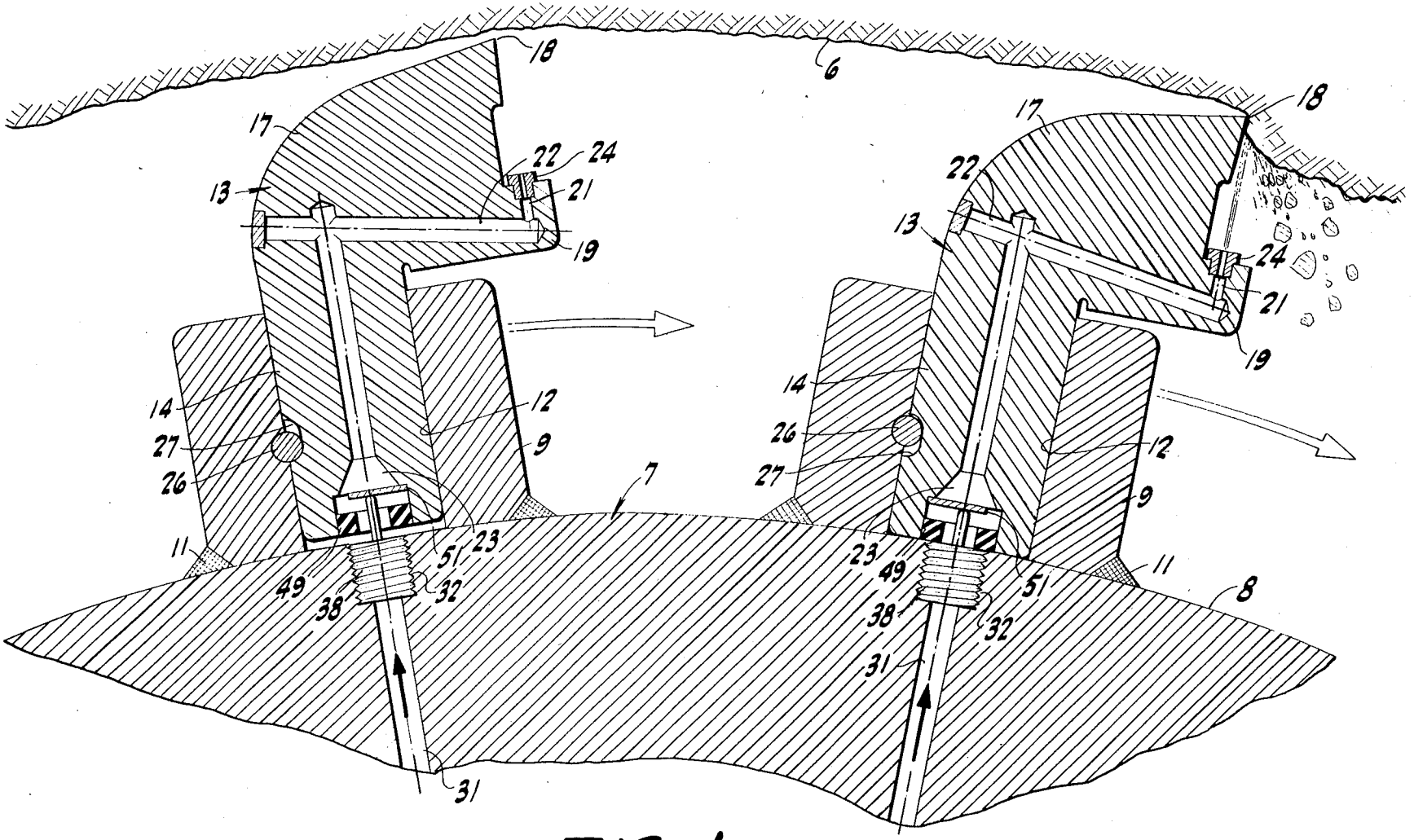
FIG. 1 is a view in cross-section through a portion of a mounting containing a number of drag bits of the invention in position to excavate a rock face.

While the use of water at the cutting site of a drag bit engaged with a hard face is known, the amount of water used, generally at high pressure, is large and wasteful. The expense of supplying high pressure water in substantial quantities is great and the later disposition of large quantities of water is also expensive as well as often awkward. For those and other beneficial reasons, there is provided an arrangement in which ample high pressure water is afforded in the critical area at the critical time but is reserved and not supplied at other times and to other areas.

In a customary environment there is a rock face 6 or similar hard face to be excavated by means of a rotary wheel 7 mounted to turn under power about a convenient center and subject to movement toward and away from the face 6 in a generally radial or longitudinal direction, or both. The wheel 7 has a periphery 8 to which are affixed at appropriate intervals a number of mountings 9 all of which are substantially similar. Each mounting is conveniently extended radially from the wheel 7 and is held thereon by welding 11. The configuration of the mounting includes a recess 12 of any convenient cross-sectional shape but preferably made circular-cylindrical along a radius of the wheel 7.

Designed to reciprocate a short extent within the recess is a bit 13 substantially L-shaped in side elevation. The bit includes a stem 14 of substantially the same cross-section as the recess 12 but slightly smaller so that the stem can fit within the recess and easily reciprocate to a limited extent with respect thereto. The bit 13 likewise has a head 17 offset ahead of and with respect to the stem. The head 17 carries a cutting edge 18 designed to encounter the hard face 6. The head 17 also has a forwardly projecting extension 19 containing an outlet 21 for a water passageway, generally designated 22, extending entirely through the bit and enlarging into a chamber 23. The outlet 21 is relatively small and carries a fine-orifice nozzle 24 directed almost exactly at the cutting edge 18 or very close thereto.

Because the bit, unless non-circular in cross-section, might undesirably rotate in the mounting 9, there is provided a cross bolt 26 extending through the mounting and operable within a short slot 27 in the drag bit stem 14. The slot and cross bolt arrangement permits the drag bit to reciprocate but only within limits, and does not permit bit rotation with respect to the mounting 9.

Since it is desired to provide a water stream from the nozzle 24 toward the rock face in the vicinity of the cutting edge 18, there is a water supply line 31 in the drum 7 connected to any suitable source (not shown) of water under pressure of the order of 2,000 to 10,000 psi or so. The passagway 31 has a threaded recess 32 near the periphery of the drum 7 into which is screwed a plug 38 (FIG. 2) having an O-ring seal 39 (FIG. 2) to preclude leakage between the plug and the drum. The plug 38 also has a relatively large center bore 41 joining a relatively small center bore 42 through a conical transition configuration 43 serving as a seat for a poppet valve 44. The poppet valve has a head 46 carrying an O-ring 47 and also has a stem 48 projecting axially through a composition, annular seal 49; for example, of nylon or comparable material. The seal 49 is designed to be abutted by a flat plate 51 of triangular shape. The plate 51 is guided by and partly spaced from the wall 52 of a bore 53 in the drag bit. The plate 51 can move between and lie against a seat 54 (FIG. 2) between the wall 52 and the tapered wall 56 of the chamber 23 in the passageway 22.

Figure 2:
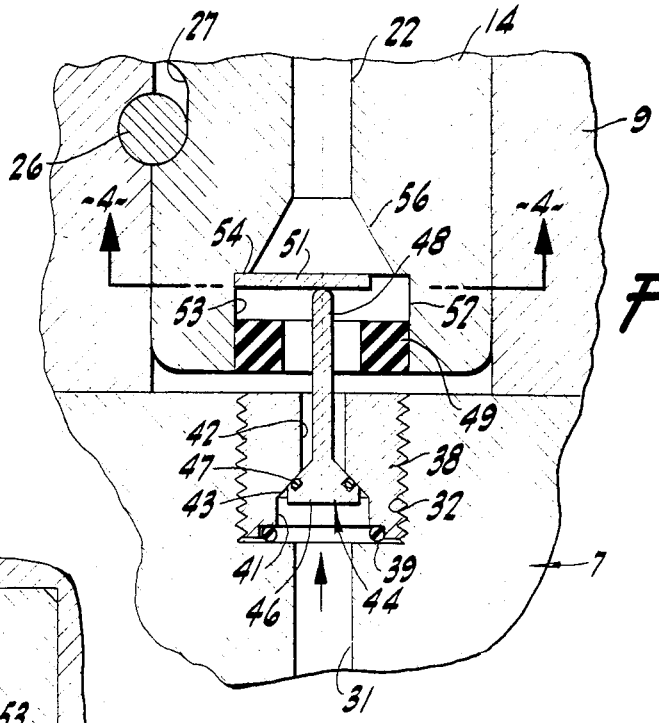
FIG. 2 is a view to an enlarged scale of one of the water controlling valves, in closed position, and a bit mounting as shown in FIG. 1.
Figure 4:
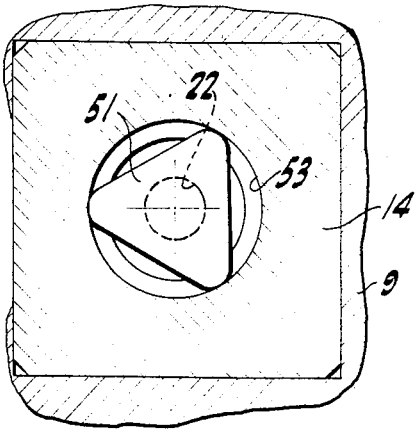
FIG. 4 is a cross-section, portions being broken away, of a detail of the drag bit construction as shown in FIG. 2.

In the operation of this structure, when there is no radially inward load on the cutting edge 18, and the bit is urged by water pressure into its outer position, as shown to the left in FIG. 1 and in FIG. 2, there is no water pressure within the drag bit because the water pressure effective upon the head 46 of the poppet 44 keeps the poppet closed against the wall of the tapered chamber 23. There may be some leakage around the bit, but this is not consequential.

Figure 3:
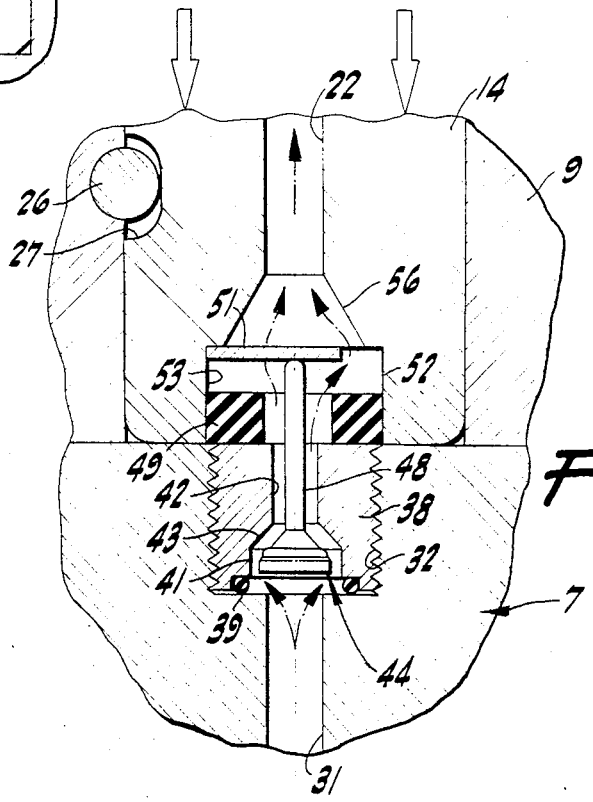
FIG. 3 is a view comparable to FIG. 2 but showing the valve in an open position.

As the mounting wheel 7 rotates or advances and as the cutting edge 18 is brought into abutment with and is deflected radially inwardly by contact with the hard face 6, the entire drag bit is moved along its axis or radially of the wheel 7. The amount of deflection required is permitted by the retainer 26 and slot 27. During such inward movement, the flat plate 51, being against the shoulder 54, as in FIG. 2, is also moved inwardly and by contact with the stem 48 causes the valve head 46 to unseat, as in FIG. 3. Water under pressure in the passageway 31 can then enter around the valve head into the bore 41 to flow along the valve stem 48 and through the annular seal 49. Flow continues around the flat plate 51 into the section 23 and the passageway 22. The water escapes from the outlet 21 and through the nozzle 24 as a jet directed toward the cutting edge 18.

Water flowing through the bore 42 is also effective to press against the end of the drag bit and to urge the drag bit to move radially outwardly. Outward movement cannot occur while the drag bit is in abutment with the hard face 6, but when the drag bit is free of abutment with the hard face, the inward force previously acting on the drag bit is no longer present. The hydraulic pressure acting in an outward direction on the base of the bit is sufficient to drive the drag bit radially outward. The motion can be stopped by the cross bolt 26 and because outward bit motion allows the poppet 44 to close, thus cutting off further water pressure. Both effects may occur separately or together.

There has been provided an arrangement easily adapted to the usual machines for hard face excavating and using, in addition to the mechanical cutting tool, a very fine jet (or jets) of high pressure, high velocity water directed close to the cutting tool edge. The jet is from a nozzle that can easily be changed for other nozzles of different sizes and internal configurations, all to the end of affording a sharp impact on the hard face being removed. The jet is located a very short distance from its target in order to reduce dispersion and to preserve its velocity. Although the jet location involves placing water passages in the bit, these are readily arranged for easy manufacture and good flow. Water is used only when the bit is cutting and is conserved at other times by being controlled and cut off by a built-in valve tight against leakage and automatically operated by the action of the bit itself. There is an effective seal between the movable bit and its mounting to prevent virtually all leakage of water despite the relative bit motion. In general, there has been provided a structure and a mode of operation that are effective in use to reduce the cutting lod and that are substantial advances over earlier arrangements and modes of operation.

I claim:

1. A drag bit construction comprising a mounting adapted to advance in a predetermined direction and having a recess, a drag bit, a stem on said bit adapted to fit in said recess whereby said bit is movably disposed in said mounting, a head on said bit and offset ahead of said stem, said bit having a cutting edge on the leading portion of said head and in advance of said mounting, means within said stem and within said head on said bit defining a water passage having an outlet, means in said outlet for defining a water jet normal to said direction and directed toward and just in advance of said cutting edge, said water passage having an entrance, a valve for controlling flow through said passage entrance, and means responsive to movement of said drag bit relative to said mounting for actuating said valve.

* * * * *